US009133803B2

(12) United States Patent
Buehner et al.

(10) Patent No.: US 9,133,803 B2
(45) Date of Patent: Sep. 15, 2015

(54) FUEL INJECTOR HAVING A PLURALITY OF FLOW-THROUGH REGIONS

(75) Inventors: Martin Buehner, Backnang (DE); Kai Gartung, Stuttgart (DE); Peter Land, Pettstadt (DE)

(73) Assignee: ROBERT BOSCH GMBH, Stuttgart (DE)

( * ) Notice: Subject to any disclaimer, the term of this patent is extended or adjusted under 35 U.S.C. 154(b) by 398 days.

(21) Appl. No.: 13/520,680

(22) PCT Filed: Dec. 6, 2010

(86) PCT No.: PCT/EP2010/068957
§ 371 (c)(1),
(2), (4) Date: Nov. 30, 2012

(87) PCT Pub. No.: WO2011/082916
PCT Pub. Date: Jul. 14, 2011

(65) Prior Publication Data

US 2013/0062441 A1 Mar. 14, 2013

(30) Foreign Application Priority Data

Jan. 8, 2010 (DE) ..... 10 2010 000 754

(51) Int. Cl.
*F02M 61/18* (2006.01)

(52) U.S. Cl.
CPC ..... *F02M 61/1806* (2013.01); *F02M 61/1886* (2013.01)

(58) Field of Classification Search
USPC ..... 239/533.12
See application file for complete search history.

(56) References Cited

U.S. PATENT DOCUMENTS

| | | | | |
|---|---|---|---|---|
| 4,408,722 | A * | 10/1983 | Frelund | 239/453 |
| 5,984,211 | A * | 11/1999 | Sugimoto et al. | 239/596 |
| 7,334,563 | B2 * | 2/2008 | Mifuji et al. | 123/299 |
| 2003/0168531 | A1 * | 9/2003 | Maier | 239/587.1 |
| 2005/0028365 | A1 * | 2/2005 | Dantes | 29/890.122 |
| 2006/0243829 | A1 * | 11/2006 | Oomori et al. | 239/584 |
| 2009/0255998 | A1 | 10/2009 | Das | |

FOREIGN PATENT DOCUMENTS

| | | |
|---|---|---|
| DE | 39 11 910 | 10/1990 |
| DE | 198 27 218 | 12/1998 |
| DE | 10 2006 049 253 | 4/2008 |
| DE | 10 2007 026122 | 12/2008 |

(Continued)

*Primary Examiner* — Darren W Gorman
*Assistant Examiner* — Adam J Rogers
(74) *Attorney, Agent, or Firm* — Kenyon & Kenyon LLP

(57) ABSTRACT

The fuel injector provides an oncoming flow out of spray-discharge orifices in a manner that reduces variance in the spray and flow-through characteristics variables. The fuel injector includes at least one excitable actuator and a valve element that is movable along a longitudinal valve axis, which collaborates in a sealing manner with a valve seat. Upstream of the valve seat, circumferentially a plurality of flow-through regions are provided, between which there are guidance regions for the valve element. The spray-discharge orifices downstream from the valve seats, whose number differs from the number of the flow-through regions, discharge the fuel finely atomized. At least two flow-through regions differ in size, such as circumferential width and/or radial depth, and/or contour. The fuel injector directly injects fuel into a combustion chamber of an engine using compression of a fuel/air mixture and spark ignition.

8 Claims, 4 Drawing Sheets

(56) References Cited

FOREIGN PATENT DOCUMENTS

| | | |
|---|---|---|
| EP | 2 108 810 | 10/2009 |
| JP | 11-13597 | 1/1999 |
| JP | 3043409 | 3/2000 |
| JP | 2000-274328 | 10/2000 |

* cited by examiner

FUEL INJECTOR HAVING A PLURALITY OF FLOW-THROUGH REGIONS

FIELD OF THE INVENTION

The present invention relates to a fuel injector.

BACKGROUND INFORMATION

FIG. 1 shows in exemplary fashion a fuel injector known from the related art, that is built into a receiving bore in a cylinder head of an internal combustion engine. A fuel injector having such a construction is discussed in German document DE 10 2006 049 253 A1. The fuel injector has an excitable actuator in the form of an electromagnetic circuit as well as a valve element that is movable along a longitudinal valve axis, a valve-closure member on a valve needle cooperating with a valve seat in a sealing manner. A valve-seat member fastened to a nozzle body at the spray-discharge end of the fuel injector has along its circumference a plurality of flow-through regions upstream of the valve seat, between which in each case guidance areas for the valve element lie. Downstream of the valve seat, a plurality of spray-discharge orifices are provided in the valve seat body. The fuel injector is particularly suitable for use in fuel-injection systems of mixture-compressing internal combustion engines having spark ignition.

SUMMARY OF THE INVENTION

The fuel injector according to the present invention, having the characterizing features described herein, has the advantage that, in a simply producible manner, an improved oncoming flow to spray-discharge orifices is able to be effected, and as a result, a reduction in variance is achieved, as opposed to other design approaches, in which the number of spray-discharge orifices does not agree with the number of oncoming flow paths upstream of the valve seat, with respect to the spray and rate of flow characteristics variables.

The oncoming flow of the spray-discharge orifices is, above all, evened out and made more stable over a course of time. Rate of flow fluctuations in the spray-discharge orifices are able to be reduced, whereby the overall spray picture leaves behind a more quiet impression. As a result, cleaner and better combustion of the fuel in the combustion in the combustion chamber is effected. Misfires, which in the extreme case are able to occur in certain injection spray patterns or designs of spray-discharge orifices in the case of known design approaches, are able to be excluded according to the present invention. In an advantageous manner, the development of the fuel injector, according to the exemplary embodiments and/or exemplary methods of the present invention, is also suitable for spray-guided combustion methods.

Advantageous further refinements of and improvements to the fuel injector described herein are rendered possible by the measures delineated in the further descriptions herein.

It is particularly advantageous if two flow-through regions upstream of the valve seat differ in size, such as circumferential width and/or radial depth and/or contour. As a function of the number of spray-discharge orifices, the flow-through regions are advantageously changed in their width and depth in such a way that wider and at the same time deeper or, on the one hand, wider as well as, on the other hand, deeper flow-through regions are designed so that they certainly and reliably cover the quantitative requirements for two spray-discharge orifices, while the flow-through regions that are narrower and at the same time have a slight depth, or, on the one hand, are narrower as well as, on the other hand, are flat, are diminished in such a way that a sufficient fuel quantity is provided for exactly one spray-discharge orifice.

Exemplary embodiments of the present invention are depicted in simplified form in the drawings and explained in greater detail in the following description.

DETAILED DESCRIPTION

Figure 1:
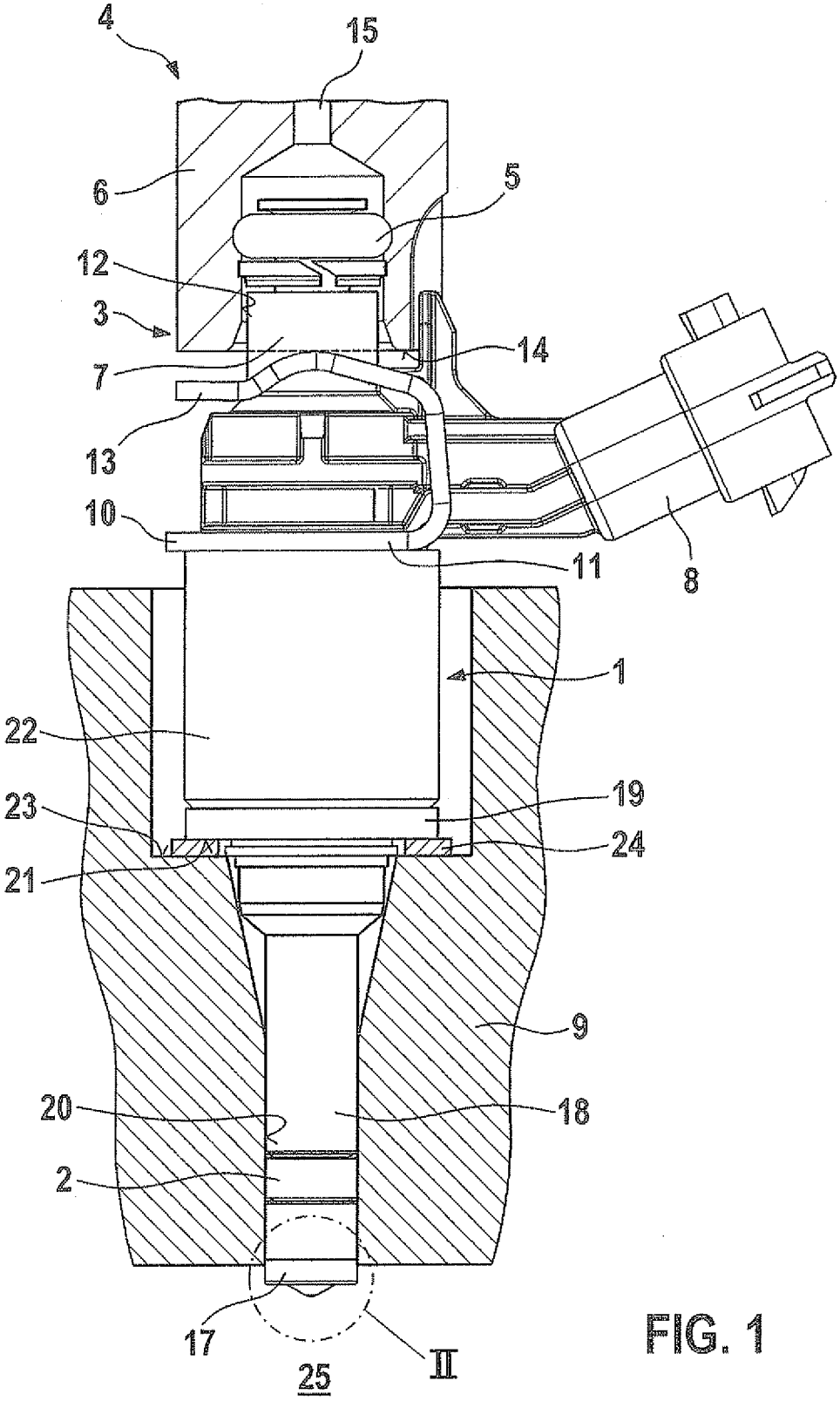
FIG. 1 shows a partially illustrated fuel injector in a known embodiment.
Figure 2:
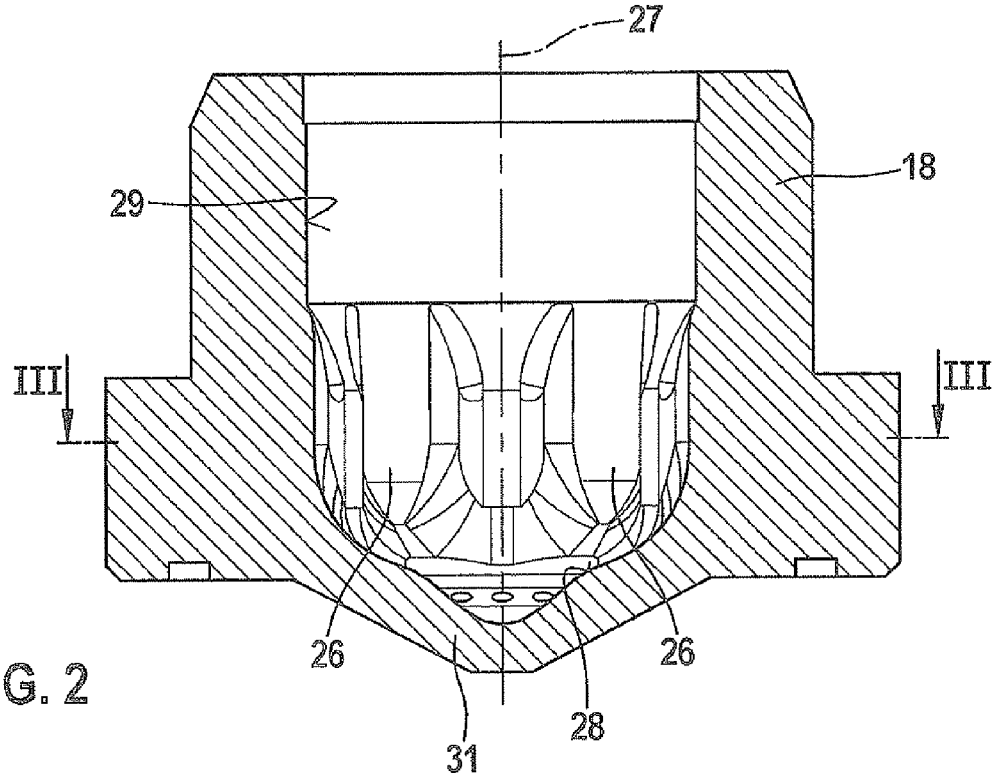
FIG. 2 shows a spray-discharge end II of the fuel injector according to FIG. 1, having a plurality of flow-through regions in a nozzle body, in a magnified view.

With the aid of FIG. 1, a known fuel injector is briefly described in its basic construction. One exemplary embodiment is shown in FIG. 1 as a side view of a valve in the form of a fuel injector 1 for fuel-injection systems of mixture-compressing internal combustion engines having externally supplied ignition. At its downstream end 17, fuel injector 1, which is embodied as a directly injecting fuel injector for the direct injection of fuel into a combustion chamber 25 of the internal combustion engine, is installed in a receiving bore 20 of a non-depicted cylinder head 9. Spray-discharge end 17 of fuel injector 1 according to FIG. 1, that is marked II, is shown in FIG. 2 in an enlarged view, since it characterizes the part of fuel injector 1 that is essential to the present invention. A sealing ring 2, in particular made of Teflon®, provides optimal sealing between fuel injector 1 from the wall of receiving bore 20 of cylinder head 9.

Between a shoulder 21 of a valve housing 22, whose downstream end is embodied as a nozzle body 18, or a lower end face 21 of a support element 19 and a shoulder 23 of receiving bore 20 that runs, for example, at right angles to the longitudinal extension of receiving bore 20, a flat intermediate element 24 is inserted, that is developed in the form of a washer.

At its intake-side end 3, fuel injector 1 has a plug connection to a fuel-distributor line (fuel rail) 4, which is sealed by a sealing ring 5 between a pipe connection 6 of fuel rail 4, shown in cross-section, and an inlet connection 7 of fuel injector 1. Fuel injector 1 is inserted into a receiving bore 12 of pipe connection 6 of fuel rail 4. Pipe connection 6 emerges from actual fuel rail 4 in one piece, for example, and has a flow opening 15 with a smaller diameter upstream from receiving bore 12, via which the flow is routed toward fuel injector 1. Fuel injector 1 has an electrical connecting plug 8 for the electrical contacting so to actuate fuel injector 1.

A holding-down clamp 10 is provided between fuel injector 1 and pipe connection 6 in order to provide clearance between fuel injector 1 and fuel rail 4 without radial forces being exerted for the most part, and in order to securely hold down fuel injector 1 in the receiving bore of the cylinder head.

Holding-down clamp 10 is designed as a bracket-shaped component, e.g., as a stamped bending part. Holding-down clamp 10 has a base element 11 in the form of a partial ring, from where a bent-off holding-down clip 13 extends at an angle, which rests against fuel rail 4 at a downstream end face 14 of pipe connection 6 in the installed state.

In FIG. 2, spray-discharge end 17 of fuel injector 1 according to FIG. 1 is shown having a plurality of flow-through regions 26 in nozzle body 18, in an enlarged view. Fuel injector 1 has at least one (not shown) excitable actuator, such as an electromagnetic circuit, a piezoelectric or a magnetostrictive actuator, as well as a valve element that is movable along a longitudinal valve axis 27. The valve element not shown (valve needle, valve closure member) acts together sealingly with a valve seat 28, which, for example, is developed at the downstream end of a blind hole bore 29 in nozzle body 18 itself. Upstream of valve seat 28, in the wall of blind hole bore 29 of nozzle body 18, circumferentially a plurality of flow-through regions 26 is developed. These flow-through regions 26 are developed in the form of flow-through pockets, which, when the valve element is installed, permits the fuel an unimpeded flow up to valve seat 28. Reference numeral 18 is intended particularly also to refer to a valve-seat member fastened to a nozzle body, as is shown, for instance, in FIG. 2 of German document DE 10 2006 049 253 A1.

Figure 3:
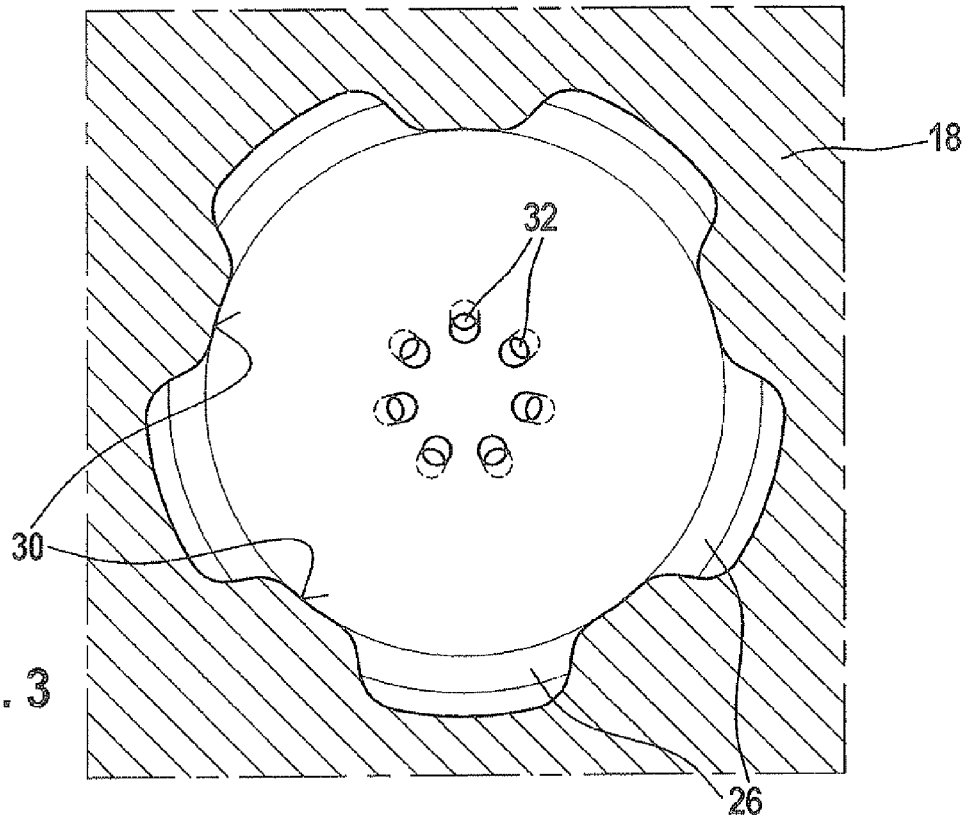
FIG. 3 shows a sectional representation along line of the known nozzle body shown in FIG. 2.

FIG. 3 shows a sectional representation along line of known nozzle body 18 shown in FIG. 2. From this view it becomes clear that flow-through regions 26 form longitudinal groove-like flow-through pockets, that are at a distance from one another. Between flow-through regions 26, in this instance, there lies in each case a guidance region 30 for the axially movable valve element. In one known embodiment, for example, five flow-through regions 26 are provided in nozzle body 18. Downstream from valve seat 28, in a floor section 31 of nozzle body 18 or in an alternative spray-orifice disk that is able to be fastened to nozzle body 18, a plurality of spray-discharge orifices 32 are developed, through which the fuel is discharged into combustion chamber 25 finely atomized. Spray-discharge orifices 32 are aligned, for example, in such a way that they run inclined slantwise, radially outwards over the thickness of floor section 31 or of the spray-orifice disk.

Usually, in the case of so-called multi-orifice valves, the number of spray-discharge orifices 32 differs from the number of flow-through regions in nozzle body 18. In the known example shown in FIG. 3, five flow-through regions 26 are provided, while downstream from valve seat 28, seven spray-discharge orifices 32 follow. Flow-through regions 26 are thus located at a regular average distance of 72° from one another, and are worked into nozzle body 18 at the same circumferential width and radial depth. Based on the different number of flow-through regions 26 and spray-discharge orifices 32, there come about instabilities in the flow of spray-discharge orifices 32, in dependence upon the valve design. This may finally lead disadvantageously to a great variance in the spray and flow-through characteristics variables. Because of the quantity assignment that is not unequivocal and not absolutely stable in time, a restlessly "flapping" spray pattern may occur.

Figure 4:
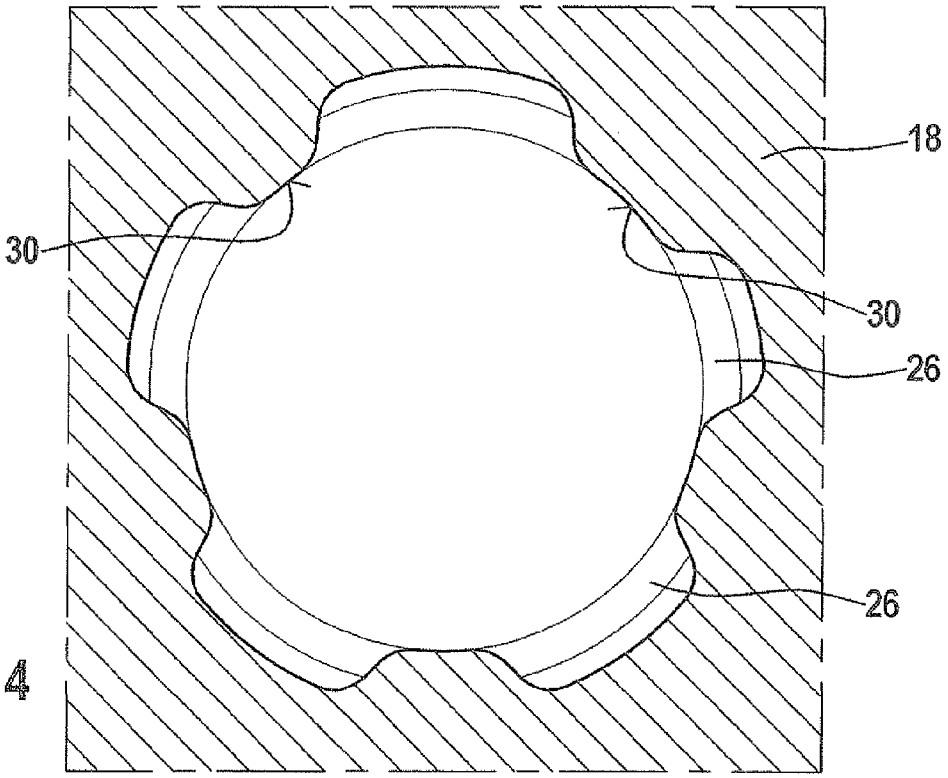
FIG. 4 show a first exemplary embodiment of a fuel injector according to the present invention, in the area of its nozzle body, in an illustration analogous to FIG. 3.

FIG. 4 shows a first exemplary embodiment of a fuel injector 1 according to the exemplary embodiments and/or exemplary methods of the present invention, in the area of its nozzle body 18, in an illustration analogous to FIG. 3. In this embodiment, the at least two flow-through regions 26 differ in their circumferential width. Depending on the number of spray-discharge orifices 32, flow-through regions 26 are now changed in their width in such a way that, for instance, wider flow-through regions 26 are designed in such a way that they certainly cover the quantitative requirement for two spray-discharge orifices 32, while narrower flow-through regions 26 are diminished with respect to the known design approach according to FIG. 3 in such a way that a sufficient fuel quantity is provided for exactly one spray-discharge orifice. In this way, an oncoming flow, that is uniform and stable in time, of spray-discharge orifices 32 is assured, and consequently, a reduction in variance is achieved in the spray and flow-through characteristics variables. For endurance test stability it is important, however, that the widths of the guidance surfaces of guidance regions 30 remain developed sufficiently large.

Figure 5:
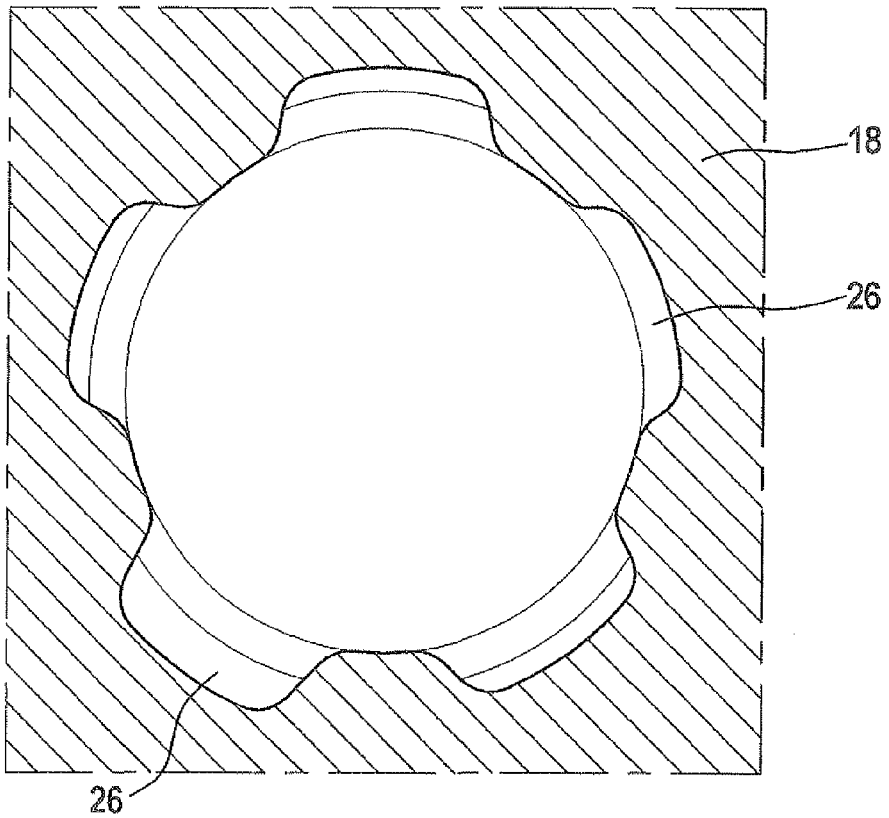
FIG. 5 shows a second exemplary embodiment of a fuel injector according to the present invention, in the area of its nozzle body, in an illustration analogous to FIG. 3.

FIG. 5 shows a second exemplary embodiment of a fuel injector 1 according to the exemplary embodiments and/or exemplary methods of the present invention, in the area of its nozzle body 18, in an illustration analogous to FIG. 3. In this embodiment, the at least two flow-through regions 26 differ in their radial depth. Depending on the number of spray-discharge orifices 32, flow-through regions 26 are now changed in their depth in such a way that, for instance, deeper flow-through regions 26 are designed in such a way that they certainly and reliably cover the quantitative requirement for two spray-discharge orifices 32, while flow-through regions 26 having a smaller depth are diminished with respect to the known design approach according to FIG. 3 in such a way that a sufficient fuel quantity is provided for exactly one spray-discharge orifice 32. In this way, an oncoming flow, that is uniform and stable in time, of spray-discharge orifices 32 is assured, and consequently, a reduction in variance is achieved in the spray and flow-through characteristics variables. The maximum depth of flow-through regions 26 is however determined in this context, among other things, by the resistance to compression of nozzle body 18 at its downstream end 17.

Figure 6:
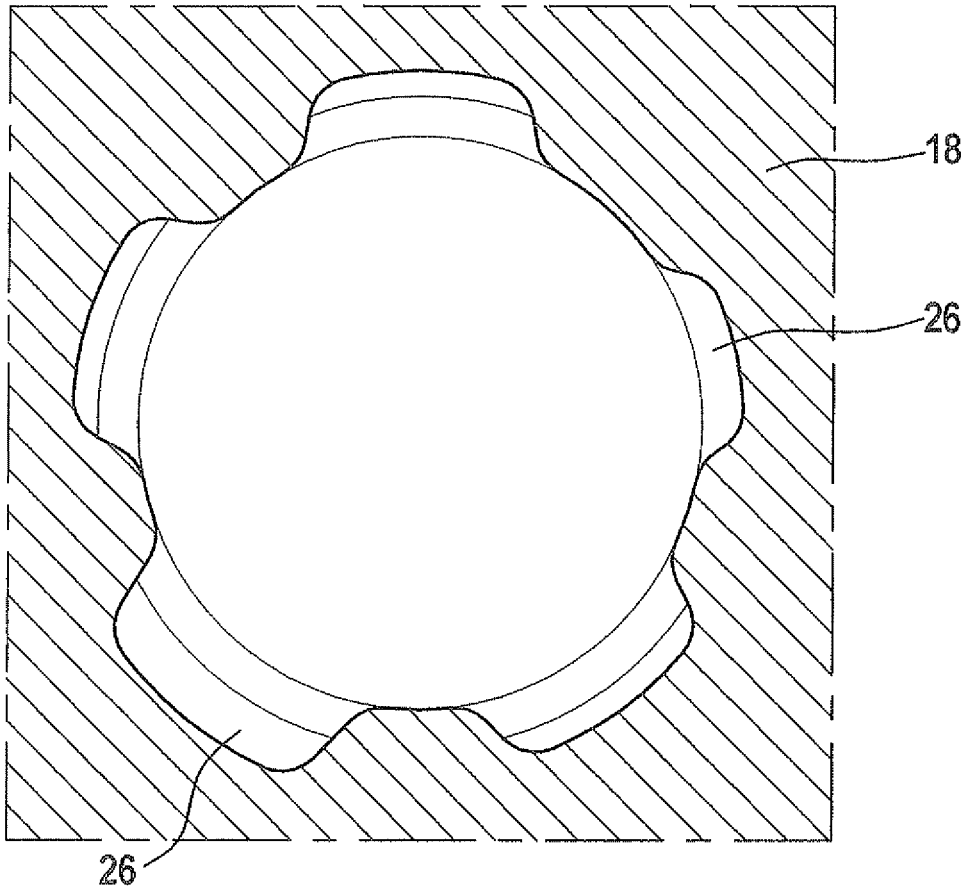
FIG. 6 shows a third exemplary embodiment of a fuel injector according to the present invention, in the area of its nozzle body, in an illustration analogous to FIG. 3.

FIG. 6 shows a third exemplary embodiment of a fuel injector 1 according to the exemplary embodiments and/or exemplary methods of the present invention, in the area of its nozzle body 18, in an illustration analogous to FIG. 3. In this embodiment, the at least two flow-through regions 26 differ in their circumferential width and their radial depth. That being the case, this variant represents a combination of the exemplary embodiments described before. As a function of the number of spray-discharge orifices 32, the flow-through regions 26 are now changed in their width and depth in such a way that wider and at the same time deeper or, on the one hand, wider as well as, on the other hand, deeper flow-through regions 26 are designed so that they certainly and reliably cover the quantitative requirements for two spray-discharge orifices 32, while the flow-through regions that are narrower and at the same time have slight depth, or, on the one hand, are narrower as well as, on the other hand, are flat, are diminished in such a way, with respect to the known design approach according to FIG. 3, that a sufficient fuel quantity is provided for exactly one spray-discharge orifice 32. In this way, an oncoming flow, that is uniform and stable in time, of spray-discharge orifices 32 is produced in an optimal way, and consequently, a reduction in variance is achieved in the spray and flow-through characteristics variables.

Alternatively, an asymmetrical distribution of the flow-through regions 26 over the circumference may also be produced, so that, with that, a uniform distribution of flow-through regions 26 is abandoned, the geometry and the dimensions of flow-through regions 26 remaining the same, but the widths of the guidance surfaces of guidance regions 30 being varied.

What is claimed is:

1. A fuel injector for a fuel injection system of an internal combustion engine, for direct injection of fuel into a combustion chamber, comprising:

at least one excitable actuator and a valve element movable along a longitudinal valve axis an connectible in a sealing manner with a valve seat;

a nozzle body at a spray-discharge end of the fuel injector;

a plurality of flow-through regions are configured in the nozzle body and positioned circumferentially and upstream of the valve seat, between which, in each case, there are guidance regions for the valve element; and a plurality of spray-discharge orifices downstream from the valve seat;

wherein a number of the plurality of the spray-discharge orifices is different from a number of the flow-through regions; and wherein at least two flow-through regions differ from each other in radial depth, such that a flow of the fuel is uniform.

2. The fuel injector of claim 1, wherein the number of spray-discharge orifices is greater than the number of flow-through regions.

3. The fuel injector of claim 2, wherein five flow-through regions and more than five spray-discharge orifices are provided.

4. The fuel injector of claim 1, wherein the spray-discharge orifices are configured in a floor section of the nozzle body or in a separate spray-orifice disk, which is fastenable to the nozzle body.

5. The fuel injector of claim 1, wherein the spray-discharge orifices are aligned so that they run radially outwards inclined in a slantwise manner.

6. The fuel injector of claim 1, wherein the flow-through regions form longitudinal groove-like flow-through pockets.

7. A fuel injector for a fuel injection system of an internal combustion engine, for direct injection of fuel into a combustion chamber, comprising:

at least one excitable actuator and a valve element movable along a longitudinal valve axis an connectible in a sealing manner with a valve seat;

a nozzle body at a spray-discharge end of the fuel injector;

a plurality of flow-through regions are configured in the nozzle body and positioned circumferentially and upstream of the valve seat, between which, in each case, there are guidance regions for the valve element; and a plurality of spray-discharge orifices downstream from the valve seat;

wherein a number of the plurality of the spray-discharge orifices is different from a number of the flow-through regions; and the geometry and the dimensions of the flow-through regions are equal, but the widths of the guidance surfaces of the guidance regions vary, so that there is a circumferentially asymmetrical distribution of the flow-through regions.

8. The fuel injector of claim 1, wherein at least two flow-through regions differ from each other in circumferential width such that a flow of the fuel is uniform.

* * * * *